US006951077B1

(12) United States Patent
Higginbotham

(10) Patent No.: US 6,951,077 B1
(45) Date of Patent: Oct. 4, 2005

(54) NON CLOGGING SCREEN

(76) Inventor: Edward Alan Higginbotham, 247 Father Judge Rd., Amherst, VA (US) 24521

( * ) Notice: Subject to any disclaimer, the term of this patent is extended or adjusted under 35 U.S.C. 154(b) by 0 days.

(21) Appl. No.: 10/635,679

(22) Filed: Aug. 7, 2003

Related U.S. Application Data

(60) Provisional application No. 60/401,781, filed on Aug. 8, 2002, now abandoned.

(51) Int. Cl.[7] ..... E04D 13/00
(52) U.S. Cl. ..... 52/12; 210/499
(58) Field of Search ..... 52/12, 13, 15, 52/670, 799.1; 210/499, 494.2, 493.1, 487, 483; 427/247

(56) References Cited

U.S. PATENT DOCUMENTS

| | | | | | |
|---|---|---|---|---|---|
| 297,382 | A | * | 4/1884 | Golding | 52/670 |
| 1,562,191 | A | * | 11/1925 | Stowe | 52/670 |
| 2,209,741 | A | * | 7/1940 | Sullivan et al | 210/474 |
| 3,855,132 | A | | 12/1974 | Dugan | |
| 4,727,689 | A | | 3/1988 | Bosler | |
| 4,841,686 | A | | 6/1989 | Rees | |
| 4,949,514 | A | | 8/1990 | Weller | |
| 4,959,932 | A | * | 10/1990 | Pfeifer | 52/12 |
| 5,010,696 | A | * | 4/1991 | Knittel | 52/12 |
| 5,406,754 | A | | 4/1995 | Cosby | |
| 5,459,965 | A | | 10/1995 | Meckstroth | |
| 5,491,998 | A | | 2/1996 | Hansen | |
| 5,495,694 | A | | 3/1996 | Kuhns | |
| 5,555,680 | A | | 9/1996 | Sweers | |
| 5,595,027 | A | | 1/1997 | Vail | |
| 5,660,001 | A | | 8/1997 | Albracht | |
| 5,755,061 | A | | 5/1998 | Chen | |
| 5,842,311 | A | | 12/1998 | Morin | |
| 5,956,904 | A | * | 9/1999 | Gentry | 52/12 |
| 6,134,843 | A | * | 10/2000 | Tregear | 52/12 |
| 6,151,837 | A | | 11/2000 | Ealer | |
| 6,164,020 | A | | 12/2000 | Nitch | |
| 6,363,662 | B1 | | 4/2002 | Coates | |
| 6,463,700 | B2 | | 10/2002 | Davis | |
| 6,598,352 | B2 | | 7/2003 | Higginbotham | |

OTHER PUBLICATIONS

"Polyester & Nylon Screening", Jan. 26, 2001, Miami Aqua–culture, Inc., p. 1.*

(Continued)

*Primary Examiner*—Naoko Slack
(74) *Attorney, Agent, or Firm*—Venable LLP; Stuart I. Smith

(57) ABSTRACT

An improved gutter shield device includes a first connecting plane of roll formed metal, a second filtering plane of roll formed metal and metallic or polymer cloth, and a third connecting plane of roll formed metal combined into an integral unit.

An elongated strip of roll formed metal includes a rear vertical plane adapted to seat beneath shingles of a roof structure. The rear vertical plane is crimped by roll forming onto the second and rear longitudinal edge of a forward extending plane that combines a fine filtering membrane with an underlying skeletal support of expanded metal as an integral unit. The expanded metal and filtering membrane so joined contain two or more v-shaped downward extending longitudinal channels within the forward extending plane that transverse the length of the forward extending plane parallel to it's first edge. The forward extending plane is bound on a first and forward longitudinal edge by a first plane of that comprises a roll formed angled z-shaped connecting metal strip for securing the gutter shield to an inwardly extending flange of a k-style gutter.

8 Claims, 11 Drawing Sheets

OTHER PUBLICATIONS

"PermaFlow Installation Instructions", Feb. 20, 1999, PermaFlow Gutter Guard System, pp. 4 and 7.*
Flow Free. TM web advertisement downloaded Aug. 6, 2003 www.flowfree.com.
Gutter Helmet. RTM web advertisement downloaded Aug. 6, 2003 www.gutterhelmet.com.
LeafGuard. RTM web advertisement downloaded Aug. 6, 2003 www.leafguard.com.
K–Guard. TM web advertisement downloaded Aug. 6, 2003 www.k–guard.com.
SheerFlow. TM web advertisement downloaded Aug. 6, 2003.

* cited by examiner

NON CLOGGING SCREEN

This application claims priority to provisional application 60/401,781, filed Aug. 8, 2002, now abandoned.

BACKGROUND FIELD OF INVENTION

The invention relates to composite screen or perforated surface and filtering membrane gutter guards. The invention employs a filtering membrane and underlying skeletal support system applicable for disallowing small twigs, leaves, pine needles, pollen, and other debris larger than 100 microns from-entering the gutter while directing rain water roof run off into an underlying rain gutter in the presence of such debris. The invention employs downward extending planes underside the filtering membrane and supporting skeletal structure that break the forward flow of water.

Unlike some prior art gutter guards which have a relatively fine-mesh polymer, fiberglass, or metal layer overlying a perforated panel that exhibits no downward water channeling planes, the gutter guard of the present invention includes a filtering screen integrally joined to a perforated expanded metal panel forming a lateral plane with downward extending water channeling paths. The absence of effective downward extending water channeling paths exhibited in prior art that employs filtering methods often allows for the forward channeling of water past rather than downward into an underlying rain gutter. Unlike prior art that does employ effective downward extending water channeling paths in a polymer body, notably LEAFFILTER.TM, the present invention has been demonstrated to achieve similar properties through a design more readily accomplished at lower cost of manufacture.

BACKGROUND PRIOR ART

The invention relates to the field of Gutter Anti-clogging Devices and particularly relates to screens with affixed fine filter membranes and to devices that employ spaced ribs or fins which act to break the forward flow of water and channel it downward into a rain gutter and which also act to prevent debris entrance into a rain gutter.

Various gutter anti-clogging devices are known in the art and some are described in issued patents.

In my patent U.S. Pat. No. 6,598,352 incorporated herein by reference, I disclose a filter configuration comprised of a debris repelling membrane, overlying a skeletal structure of ellipsoid rods spaced and resting on vertical planes that serve to break the forward flow of water and to channel water onto and through its integral perforated horizontal plane. Included herein is product literature for LEAFFILTER.RTM., a gutter guard patterned after designs disclosed in U.S. Pat. No. 6,598,352. To date, LEAFFILTER.RTM. has been noted to remain free enough of debris clogs and/or coatings of scum, oil, and pollutants so as to disallow gutter clogs in every known instance of it's installation onto rain gutter systems attached to at least eight thousand residential homes. The LEAFFILTER.RTM. system, however, is costly to manufacture in comparison to other gutter guard systems.

U.S. Pat. No. 6,463,700 to Davis teaches a composite gutter guard, marketed as Sheer Flo.RTM., comprising a polymer coated fiberglass mesh filter cloth overlying and sonic welded to an underlying perforated plane, disclosed in claims 1 and 4. Davis specifically teaches employment of a medium filter opening fiberglass mesh rather than a fine metal or polymer mesh cloth, disclosed in Column 1 lines 19–35. Such fiberglass mesh of medium openings can be shown to allow the lodging of pine needle tips and to be subject to water-proofing due to oil leaching from roofing shingles. This may cause permanent accumulation of debris upon the composite gutter guard and water-proofing may allow forward, rather than downward flow of water to occur. In instances of high ambient temperatures sonic welded fiberglass has been shown to break free of the underlying polymer plane and the composite gutter guard has been shown to warp and wave due to heat deformation. Davis teaches a mostly single planar composite gutter guard that allows much forward underflow of water to occur on the underside of the disclosed invention and such underflow acts to oppose downward flow of water through perforations.

U.S. Pat. No. 6,164,020 to Nitch teaches a gutter screen for preventing the accumulation of debris within a gutter. Nitch teaches a gutter screen that has a plurality of v-shaped bars positioned to run above and generally parallel to the gutter, disclosed in the ABSTRACT. Nitch teaches that the unique shape of the bars minimize the surface area of the underside of the screen decreases water tension on the underside of the screen and postulates that this decreases the ability of water to accumulate on the underside of the screen which promotes the pulling of water into the gutter, disclosed in Col. 2 lines 45 through 50. Such a device can be shown to eventually allow debris to accumulate within the spaces between v-shaped bars. Such a device can additionally be shown to allow the forward channeling of water to occur as an underflow from tip to tip of the downward most portion of the v-shaped bars due to their close spacing and lack of a length of downward extension that would provide a greater directed downward flow of water into the underlying gutter. This and other prior art do not recognize that water adhesion surfaces extending downward from a planar surface into a rain gutter in a height staggered manner or that are separated by a minimum of one inch provide greater siphoning action and are less likely to be overcome by a forward channeling of under flowing water on the underside of surfaces that receive water through perforations or open channels than is reliance on a lesser amount of water adhesion on the underside of perforated surfaces or screens with bottom most water dispersing areas that are closely spaced and follow mostly horizontally linear or follow a linear path that angles downward from the rear most portion of a gutter guard to the front lip of a rain gutter. Allowing for greater spacing of rods or fins or water channeling paths or staggering and/or extending the height of rods or fins so that they extend to a depth that the volume of water they channel downward overcomes by sheer weight and gravity an opposing underflow and continues a downward flow into an underlying gutter has not been found to be a simple matter of anticipation, or design choice by those skilled in the arts. Rather, it has proved to be unclaimed in disclosed prior art and untested in the field with the exception of the Leaffilter.RTM. gutter guard which has proved to be very efficient at channeling water downward into a rain gutter while disallowing either the rain gutter or the gutter guard to clog or exhibit an overflow of water. Nitch teaches that fine screens allow for water run-off and are less capable of receiving water than other structural components such as bars or ribs, disclosed in Col. 1 lines 33–35. This and other prior art such as U.S. Pat. No. 6,463,700 to Davis do not recognize that fine screens can be shown to exhibit great water permeability and downward water channeling properties when contacting ovaled or angled edged surfaces resting on downward extending legs as is disclosed in U.S. Pat. No. 6,598,352 to Higginbotham, Col. 18 lines 26–67, Col. 19 lines 1–54.

U.S. Pat. No. 5,755,061 to Chen teaches a rain cover that includes pairs of adjacent fins separated by a uniform traverse gap that significantly increases the return of water to the gutter by surface tension with the fin walls, disclosed in the ABSTRACT. As occurs with U.S. Pat. No. 6,146,020, copious amounts of roof runoff may negate the intended effect of water returning to the gutter allowing for forward flow of water past the gutter. The bottom terminal points of the fin walls Chen teaches exist in the same linear plane as do the bottom terminal points of the rods Nitch teaches in U.S. Pat. No. 6,146,020.

This allows a forward underflow (beneath the topmost surface of a perforated or open channeled plane) of water to occur. In my U.S. Pat. No. 6,598,352 it is disclosed that such forward rather than downward flow of water has been shown to cease if downward extending planes or rods of varying heights, disallowing a linear channeling path for water to follow, and sufficiently spaced are employed beneath the top most surface of water receiving areas but the disclosed preferred embodiment has been shown costly to manufacture.

U.S. Pat. No. 5,557,891 to Albracht teaches a gutter protection system for preventing entrance of debris into a rain gutter. Albracht teaches a gutter protection system to include a single continuous two sided well with angled sides and perforated bottom shelf 9 into which rainwater will flow and empty into the rain gutter below. The well is of a depth, which is capable of receiving a filter mesh material. However, attempts to insert or cover such open channels of "reverse-curve" devices with filter meshes or cloths is known to prevent rainwater from entering the water receiving channels. This occurrence exists because of the tendency of such membranes, (unsupported by a proper skeletal structure), to channel water, by means of water adhesion along the interconnected paths existing in the filter membranes (and in the enclosures they may be contained by or in), past the intended water-receiving channel and to the ground. This occurrence also exists because of the tendency of filter mediums of any present known design or structure to quickly waterproof or clog when inserted into such channels creating even greater channeling of rainwater forward into a spill past an underlying rain gutter. Filtering of such open, recessed, channels existing in Albracht's invention as well as in U.S. Pat. No. 5,010,696, to Knittel, U.S. Pat. No. 2,672,832 to Goetz, U.S. Pat. No. 5,459,965 & 5,181,350 to Meckstroth, U.S. Pat. No. 5,491,998 to Hansen, U.S. Pat. No. 4,757,649 to Vahldieck and in similar "reverse-curved" inventions that rely on "reverse-curved" surfaces channeling water into an open channel have been known to disallow entrance of rainwater into the water-receiving channels. Albracht's as well as previous and succeeding similar inventions have therefore notably avoided the utilization of filter insertions. What may appear as a logical anticipation by such inventions at first glance, (inserting of a filter mesh or material into the channel), has been shown to be undesirable and ineffective across a broad spectrum of filtering materials: Employing insertable filters into such inventions has not been found to be a simple matter of anticipation, or design choice of filter medium by those skilled in the arts. Rather, it has proved to be an ineffective option, with any known filter medium, when attempted in the field. Such attempts, in the field, have demonstrated that the filter mediums will eventually require manual cleaning.

German Patent 5,905,961 teaches a gutter protection system for preventing the entrance of debris into a rain gutter. The German patent teaches a gutter protection system to include a single continuous two sided well 7 with angled sides and perforated bottom shelf which rainwater will flow and empty into the rain gutter below. The well is recessed beneath and between two solid lateral same plane shelves close to the front of the system for water passage near and nearly level with the front top lip of the gutter. The well is of a depth, which is capable of receiving a filter mesh material. However, for the reasons described in the preceding paragraphs, an ability to attach a medium to an invention, not specifically designed to utilize such a medium, may not result in an effective anticipation by an invention. Rather, the result may be a diminishing of the invention and its improvements as is the case in Albracht's patent 5,557,891, the German Patent, and similar inventions employing recessed wells or channels between adjoining planes or curvatures.

U.S. Pat. No. 5,595,027 to Vail teaches a continuous opening 24A between the two top shelves. Vail teaches a gutter protection system having a single continuous well 25, the well having a depth allowing insertion and retention of filter mesh material 26 (a top portion of the filler mesh material capable of being fully exposed at the holes). Vail does teach a gutter protection system designed to incorporate an insertable filter material into a recessed well. However, Vail notably names and intends the filter medium to be a tangled mesh fiberglass five times the thickness of the invention body. This type of filtration medium, also claimed in U.S. Pat. No. 4,841,686 to Rees, and in prior art currently marketed as FLOW-FREE. RTM. is known to trap and hold debris within itself which, by design, most filter mediums are intended to do, i.e.: trap and hold debris. Vail's invention does initially prevent some debris from entering an underlying rain gutter but gradually becomes ineffective at channeling water into a rain gutter due to the propensity of their claimed filter mediums to clog with debris. Though Vail's invention embodies an insertable filter, such filter is not readily accessible for cleaning when such cleaning is necessitated. The gutter cover must be removed and uplifted for cleaning and, the filter medium is not easily and readily inserted replaced into its longitudinal containing channel extending three or more feet. It is often noted, in the field, that these and similar inventions hold fast pine needles in great numbers which presents an unsightly appearance as well as create debris dams behind the upwardly extended and trapped pine needles. Such filter meshes and non-woven lofty fiber mesh materials, even when composed of finer micro-porous materials, additionally tend to clog and fill with oak tassels and other smaller organic debris because they are not resting, by design, on a skeletal structure that encourages greater water flow through its overlying filter membrane than exists when such filter meshes or membranes contact planar continuously-connected surfaces. Known filter mediums of larger openings tend to trap and hold debris. Known filter mediums smaller openings clog or "heal over" with pollen and dirt that becomes embedded and remains in the finer micro-porous filter mediums. There had not been found, as a matter of common knowledge or anticipation, an effective water-permeable, non-clogging "medium-of-choice" that can be chosen, in lieu of claimed or illustrated filter mediums in prior art, that is able to overcome the inherent tendencies of any known filter mediums to clog when applied to or inserted within the types of water receiving wells and channels noted in prior art until such a medium of inter connected centered threads was disclosed in my U.S. Pat. No. 6,598,352 Col. 22 lines 47–50. The present invention will employ such medium and utilize such in an embodiment less costly to manufacture while remaining effective.

Vail also discloses that filter mesh material 26 is recessed beneath a planar surface that utilizes perforations in the plane to direct water to the filter medium beneath. Such perforated planar surfaces as utilized by Vail, by Sweers U.S. Pat. No. 5,555,680, by Morin U.S. Pat. No. 5,842,311 and by similar prior art are known to only be partially effective at channeling water downward through the open apertures rather than forward across the body of the invention and to the ground. This occurs because of the principal of water adhesion: rainwater tends to flow around perforations as much as downward through them, and miss the rain gutter entirely. Also, in observing perforated planes such as utilized by Vail and similar inventions (where rainwater experiences its first contact with a perforated plane) it is apparent that they present much surface area impervious to downward water flow disallowing such inventions from receiving much of the rainwater contacting them.

A simple design choice or anticipation of multiplying the perforations can result in a weakened body subject to deformity when exposed to the weight of snow and/or debris or when, in the case of polymer bodies, exposed to summer temperatures and sunlight.

U.S. Pat. No. 5,406,754 to Cosby teaches a gutter guard comprising a fine screen supported by a structural stiffening matrix support that prevents the penetration of even fine debris from entering a gutter. When lesser amounts of water flow are present such a device will allow water flow through its combination of screens downward into the gutter. However, during heavy rainfall, roof runoff is known to simply travel over the top most surface of such a device past an underlying gutter rather that downward into the gutter. As with other devices aforementioned in preceding paragraphs, this may occur due to a forward moving underflow of water that can occur beneath the top most surface of nearly planar gutter guards that do not incorporate downward extending planes that break forward flow of water.

U.S. Pat. No. 4,841,686 to Rees teaches an improvement for rain gutters comprising a filter attachment, which is constructed to fit over the open end of a gutter. The filter attachment comprised an elongated screen to the underside of which is clamped a fibrous material such as fiberglass. Rees teaches in the Background of The Invention that many devices, such as slotted or perforated metal sheets, or screens of wire or other material, or plastic foam, have been used in prior art to cover the open tops of gutters to filter out foreign material. He states that success with such devices has been limited because small debris and pine needles still may enter through them into a rain gutter and clog its downspout opening and or lodge in and clog the devices themselves. Rees teaches that his use of a finer opening tangled fiberglass filter sandwiched between two lateral screens will eliminate such clogging of the device by smaller debris. However, in practice it is known that such devices as is disclosed by Rees are only partially effective at shedding debris while channeling rainwater into an underlying gutter. Shingle oil leaching off of certain roof coverings, pollen, dust, dirt, and other fine debris are known to "heal over such devices clogging and/or effectively "water-proofing" them and necessitate the manual cleaning they seek to eliminate. (If not because of the larger debris, because of the fine debris and pollutants). Additionally, again as with other prior art that seeks to employ filter medium screening of debris; the filter medium utilized by Rees rests on an inter-connected planar surface which provides non-broken continuous paths over and under which water will flow, by means of water adhesion, to the front of a gutter and spill to the ground rather than drop downward into an underlying rain gutter. Whether filter medium is "sandwiched" between perforated planes or screens as in Rees' invention, or such filter medium exists below perforated planes or screens and is contained in a well or channel, water will tend to flow forward along continuous paths through cur as well as downward into an underlying rain gutter achieving less than desirable water-channeling into a rain gutter.

U.S. Pat. No. 5,956,904 to Gentry teaches a fist fine screen having mesh openings affixed to an underlying screen of larger openings. Both screens are elastically deformable to permit a user to compress the invention for insertion into a rain gutter. Gentry, as Rees, recognizes the inability of prior art to prevent entrance of finer debris into a rain gutter, and Gentry, as Rees, relies on a much finer screen mesh than is employed by prior art to achieve prevention of finer debris entrance into a rain gutter. In both the Gentry and Rees prior art, and their improvements over less effective filter mediums of previous prior art, it becomes apparent that anticipation of improved filter medium or configurations is not viewed as a matter of simple anticipation of prior art which has, or could, employ filter medium. It becomes apparent that improved filtering methods may be viewed as patentable unique inventions in and of themselves and not necessarily an anticipation or matter of design choice of a better filter medium or method being applied to or substituted within prior art that does or could employ filter medium. However, though Rees and Gentry did achieve finer filtration over filter medium utilized in prior art, their inventions also exhibit a tendency to channel water past an underlying gutter and/or to heal over with finer dirt, pollen, and other pollutants and clog thereby requiring manual cleaning. Additionally, when filter medium is applied to or rested upon planar perforated or screen meshed surfaces, there is a notable tendency for the underlying perforated plane or screen to channel water past the gutter where it will then spill to the ground. It has also been noted that prior art listed herein exhibits a tendency to allow filter cloth mediums to sag into the opening of their underlying supporting structures. To compensate for forward channeling of water, prior art embodies open apertures spaced too distantly, or allows the apertures themselves to encompass too large an area, thereby allowing sagging of overlying filter membranes and cloths. Such sagging creates pockets wherein debris tends to settle and enmesh.

U.S. Pat. No. 3,855,132 to Dugan teaches a porous solid material which is installed in the gutter to form an upper barrier surface (against debris entrance into a rain gutter). Though Dugan anticipates that any debris gathered on the upper barrier surface will dry and blow away, that is not always the case with this or similar devices. In practice, such devices are known to "heal over" with pollen, oil, and other pollutants and effectively waterproof or clog the device rendering it ineffective in that they prevent both debris and water from entering a rain gutter. Pollen may actually cement debris to the top surface of such devices and fail to allow wash-off even after repeated rains. U.S. Pat. No. 4,949,514 to Weller sought to present more water receiving top surface of a similar solid porous device by undulating the top surface but, in fact, effectively created debris "traps" with the peak and valley undulation. As with other prior art, such devices may work effectively for a period of time but tend to eventually channel water past a rain gutter, due to eventual clogging of the device itself.

There are several commercial filtering products designed to prevent foreign matter buildup in gutters. For example the FLOW-FREE. RTM. gutter protection system sold by DCI of Clifton Heights, Pa. Comprises a 0.75-inch thick nylon mesh material designed to fit within 5-inch K type gutters to seal the gutters and downspout systems from debris and snow buildup. The FLOW-FREE. RTM. device fits over the hanging brackets of the gutters and one side extends to the bottom of the gutter to prevent the collapse into the gutter. However, as in other filtering attempts, shingle material and pine needles can become trapped in the coarse nylon mesh and must be periodically cleaned.

U.S. Pat. No. 6,134,843 to Tregear teaches a gutter device that has an elongated matting having a plurality of open cones arranged in transverse and longitudinal rows, the base of the cones defining a lower first plane and the apexes of the cones defining an upper second plane Col. 5 lines 16–25. Although the Tregear device overcomes the eventual trapping of larger debris within a filtering mesh composed of fabric sufficiently smooth to prevent the trapping of debris he notes in prior art, the Tregear device tends to eventually allow pollen, oil which may leach from asphalt shingles, oak tassels, and finer seeds and debris to coat and heal over a top-most matting screen it employs to disallow larger debris from becoming entangled in the larger aperatured filtering medium it covers. Filtering mediums (exhibiting tightly woven, knitted, or tangled mesh threads to achieve density or "smoothness") disclosed in Tregear and other prior art have been unable to achieve imperviousness to waterproofing and clogging effects caused by a healing or pasting over of such surfaces by pollen, fine dirt, scum, oils, and air and water pollutants. Tregear indicates that filtered configurations such as a commercially available attic ventilation system known as Roll Vent.RTM. manufactured by Benjamin Obdyke, Inc. Warminster, PA. is suitable, with modifications that accommodate its fitting into a rain gutter. However, such a device has been noted, even in its original intended application, to require cleaning (as do most attic screens and filters) to remove dust, dirt, and pollen that combine with moisture to form adhesive coatings that can scum or heal over such attic filters. Additionally, referring again to Tregear's device, a lower first plane tends to channel water toward the front lip of a rain gutter, rather than allowing it's free passage downward, and allow the feeding and spilling of water up and over the front lip of a rain gutter by means of water-adhesion channels created in the lower first plane.

Prior art has employed filter cloths over underlying mesh, screens, cones, longitudinal rods, however such prior art has eventually been realized as unable to prevent an eventual clogging of their finer filtering membranes by pollen, dirt, oak tassels, and finer debris. Such prior art has been noted to succumb to eventual clogging by the healing over of debris which adheres itself to surfaces when intermingled with organic oils, oily pollen, and shingle oil that act as an adhesive. The hoped for cleaning of leaves, pine needles, seed pods and other debris by water flow or wind, envisioned by Tregear and other prior art, is often not realized due to their adherence to surfaces by pollen, oils, pollutants, and silica dusts and water mists. The cleaning of adhesive oils, fine dirt, and particularly of the scum and paste formed by pollen and silica dust (common in many soil types) by flowing water or wind is almost never realized in prior art.

Prior art that has relied on reverse curved surfaces channeling water inside a rain gutter due to surface tension, of varied configurations and pluralities, arranged longitudinally, have been noted to lose their surface tension feature as pollen, oil, scum, eventually adhere to them. Additionally, multi-channeled embodiments of longitudinal reverse curve prior art have been noted to allow their water receiving channels to become packed with pine needles, oak tassels, other debris, and eventually clog disallowing the free passage of water into a rain gutter. Examples of such prior art are seen in a commercial product. In this and similar Commercial products, dirt and mildew can build up on the bull-nose of the curve preventing water from entering the gutter. These commercial products state such, in literature to homeowners that advises them on the proper method of cleaning and maintaining their products.

None of theses above-described systems keep all debris out of a gutter system allowing water alone to enter, for an extended length of time. Some allow lodging and embedding of pine needles and other debris is able to occur within their open water receiving areas causing them to channel water past a rain gutter. Others allow such debris to enter and clog a rain gutter's downspout opening. Still others, particularly those employing filter membranes, succumb to a paste and or scum-like healing over and clogging of their filtration-membranes over time rendering them unable to channel water into a rain gutter. Pollen and silica dirt, particularly, are noted to cement even larger debris to the filter, screen, mesh, perforated opening, and/or reverse curved surfaces of prior art, adhering debris to prior art in a manner that was not envisioned.

Accordingly, it is an object of the present invention to provide a gutter shield that permits drainage of water runoff into the gutter trench without debris becoming entrenched or embedded within the surface of the device itself and that employs a filtration membrane configuration that possesses sufficient self-cleaning properties that prevent the buildup of scum, oil, dirt, pollen, and pollutants that necessitate eventual manual cleaning as is almost always the case with prior art.

Another object of the present invention is to provide a gutter shield that redirects water and self-cleans as effectively has the Leaffilter.RTM. gutter shield has been shown to do but do so at a lower cost of manufacture.

Another object of the present invention is to provide a gutter shield that will accept more water run-off into a five inch K-style rain gutter than such a gutter's downspout opening is able to drain before allowing the rain gutter to overflow (in instances where a single three-inch by five-inch downspout is installed to service 600 square feet of roofing surface).

Other objects will appear hereinafter.

SUMMARY

Accordingly, it is an object of the present invention to provide a gutter shield that permits drainage of water runoff into the gutter trench without debris becoming entrenched or embedded within the surface of the device itself and that employs a filtration membrane configuration that possesses sufficient self-cleaning properties that prevent the buildup of scum, oil, dirt, pollen, and pollutants that necessitate eventual manual cleaning as is almost always the case with prior art.

Another object of the present invention is to provide a gutter shield that redirects water and self-clean as effectively as the Leaffilter.RTM gutter shield has been shown to do but do so at a lower cost of manufacture.

Another object of the present invention is to provide a gutter shield that will accept more water run-off into a five inch K-style rain gutter than such gutter's downspout opening is able to drain before allowing the rain gutter to overflow (in instances where a single three-inch by five-inch downspout is installed to service 600 square feet of roofing surface).

Other objects with appear hereinafter.

It has now been discovered that the above and other objects of the present invention may be accomplished in the following manner. Specifically, the present invention provides a gutter screen for use with gutters having an elongated opening. Normally the gutters are attached to or suspended from a building.

An important feature of the present invention is to capture and redirect water flow across it's filtering membrane downward through the underlying skeletal support of expanded metal and into an underlying rain gutter as effectively as, and at a lower cost of manufacture, than does the LEAFFILTER.TM gutter guard.

Another important feature of the present invention is to redirect downward flow of water rearward to the rear most portion of a rain gutter by means of angled walls comprising diamond shaped openings present in the underlying skeletal support of expanded metal whereby a forward underflow of water on the bottom surfaces of the gutter screen is greatly diminished.

The gutter shield device includes a first connecting plane of roll formed metal, a second filtering plane of roll formed metal and metallic or polymer cloth, and a third connecting plane of roll formed metal roll formed into an integral unit. The gutter shield device is adapted for being positioned in a longitudinally extending k-style gutter used for capturing rainwater runoff from roof structures.

According to another preferred body of the invention, the first plane comprises an angled z-shaped connecting member for securing the gutter shield device to an inwardly extending flange of a k-style gutter to hold the gutter shield in place during use. According to another preferred body of the invention, the first plane is fastened longitudinally along the first edge of the second plane by means of roll formed crimps. According to another preferred body of the invention, the second plane comprises a combined fine filtering membrane with an underlying skeletal support of expanded metal support that may be assembled together as an integral unit.

According to another preferred body of the invention, the filtering membrane has mesh openings not greater than 80 microns, top and bottom surfaces, first and second opposing edges, two opposing ends and an elongated axis extending between opposing ends.

Adjacent the filtering membrane is the expanded metal support having diamond shaped openings, each wall of the opening angled downward at approximately 30 degrees, top and bottom surfaces, first and second opposing edges and two opposing ends.

According to another preferred body of the invention, the first opposing edge of the expanded metal is fastened and crimped by means of roll forming to the first opposing edge of the filtering membrane to form a first edge portion.

According to another preferred body of the invention, the second opposing edge of the expanded metal is fastened and crimped by means of roll forming to the second opposing edge of the filtering membrane to form a second edge portion. The expanded metal support and filtering membrane, so joined as an integral plane, are then roll-formed to create two or more v-shaped downward extending longitudinal channels within the integral plane that transverse the length of the invention parallel to the first and second edge portions for redirecting water flow downward into the gutter.

According to another preferred body of the invention, the third plane comprises a lateral connecting plane longitudinally fastened to the second edge of the second plane for securing the gutter shield device beneath the shingles of a roof.

The first and third connecting planes provide a fastening method for securing the gutter shield device in place cover a gutter.

In another embodiment, the third plane comprises a rear vertical leg fastened to and perpendicular to the second plane for resting on a gutter spike or gutter hangar for securing the gutter shield within the open lateral top of a rain gutter.

OBJECTS AND ADVANTAGES

Of the above described systems, the LEAFFILTER.TM self cleaning gutter guard is known to have demonstrated an ability to, in almost every circumstance and over a period of years, prevent either a rain gutter or the gutter guard itself from clogging, or failing to direct water into a gutters downspout, due to debris lodging, or pollen or scum or oil accumulation. Of the remainder of the above described systems it has been noted that a buildup or coating of debris, pollutants, and oils either cause water adhesion properties to be lost or cause blockage of water receiving openings resulting in rain water roof run-off to flow past, rather than into, an underlying rain gutter.

An object of the present invention is to provide the above noted advantages, accomplished in the LEAFFILTER.TM. gutter guard, at a reduced cost to manufacturer and consumer:

To provide a gutter shield device that employs a fine filtration combination that is not subject to gumming or healing over by pollen, silica dust, oils, and other very fine debris. To provide a filtration configuration and encompassing body that eliminates any forward channeling of rain water on surfaces or undersurfaces as is noted in prior art.

Another object of the present invention is to provide a filtration configuration that does not allow its filter cloth or membrane to sag and develop debris catching pockets.

Another object of the present invention is to provide the noted advantages, accomplished in the LEAFFILTER.TM. gutter guard, at a reduced cost to manufacturer and consumer.

Another object of the present invention is to provide the above advantages in a readily roll-formed gutter that may be manufactured on-site, via mobile roll-forming machines, at residential locations allowing for custom fitting of different rain gutters present on residential homes.

THE DRAWINGS FIGURES 1–24

REFERENCE NUMERALS IN DRAWINGS

Figure 1:
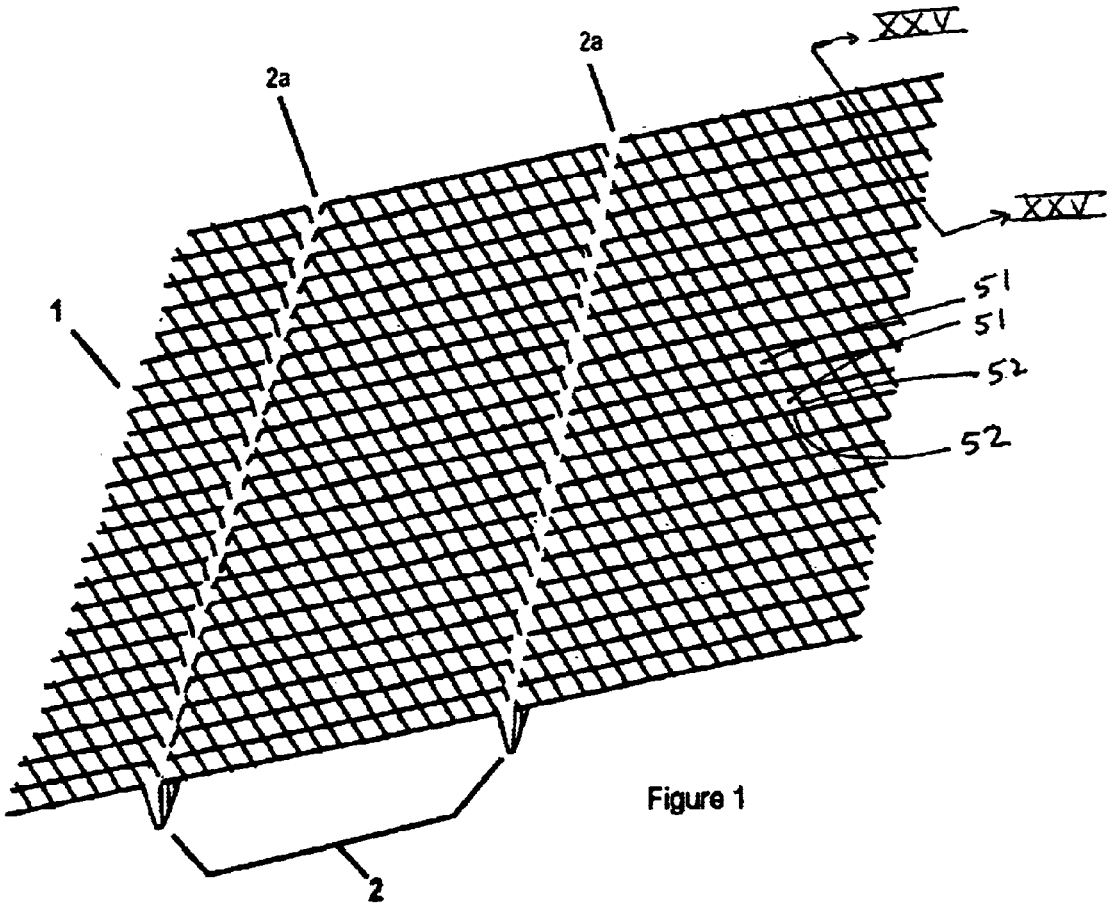
FIG. 1 is a top view of a wire screen which is a component of the present invention.

| | |
|---|---|
| 1 | Expanded metal screen |
| 1a | width of expanded metal screen |
| 2 | Downward extending channels |
| 2a | gap between walls of downward extending channels |
| 3 | fine mesh membrane |
| 3a | width of fine mesh membrane |
| 4 | glue strips |
| 5 | sprayed liquid adhesive |
| 6 | metal z-shaped sleeve |
| 7 | metal u-shaped sleeve |
| 8 | crimps |
| 9 | rear connecting sleeve |
| 10 | width of top plane of rear connecting sleeve |
| 11 | recessed channel |

-continued

REFERENCE NUMERALS IN DRAWINGS

| | |
|---|---|
| 12 | opening |
| 13 | gripping tooth |
| 14 | width of recessed channel |
| 15 | lower plane of rear connecting sleeve |
| 16 | lower plane of rear connecting sleeve |
| 17 | lower plane of rear connecting sleeve |
| 18 | width of first segment of top plane of rear connecting sleeve |
| 19 | width of second segment of top plane of rear connecting sleeve |
| 20 | width of third segment of top plane of rear connecting sleeve |
| 21 | top horizontal plane of rear connecting member |
| 22 | top angled plane of rear connecting member |
| 23 | vertical rear leg of rear connecting member |
| 24 | height of lower segment of vertical rear leg of rear connecting member |
| 25a–c | Decoiling Cylinder |
| 26, | rolling assembly cylinder |
| 26a, b, c | rolling assembly cylinders |
| 27, 27a–e | shaping and crimping cylinders |
| 28 | roofing shingles |
| 29 | rain gutter |
| 30 | front lip of k-style gutter |
| 31 | subroof |
| 32 | preferred embodiments of present invention |
| 33 | fascia board |

DESCRIPTION OF THE PREFERRED EMBODIMENTS AND BEST MODE

Figure 19:
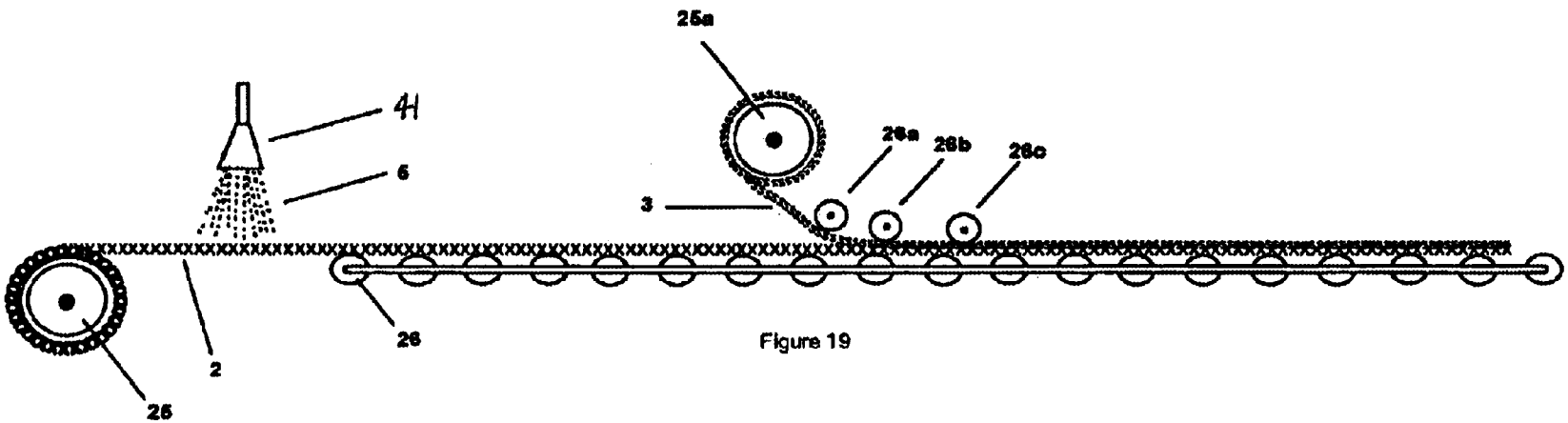
FIG. 19 is a cross sectional view of an assembling line.

Referring now specifically to the drawings, in FIG. 1 a gutter screen (protector) is illustrated 1 with downward extending water receiving channels 2. The preferred gauge of the gutter screen wire is approximately 0.035 to 0.055 inch, which is suitably thick to maintain it's shape and not deform or dip under load bearing weight of snow and ice. The preferred gauge of the gutter screen wire is also of a narrow enough diameter (0.035 to 0.055) to allow the screen 1 sufficient flexibility to be wrapped around a spindle 25 and later unrolled in a manufacturing process as illustrated in FIG. 19.

Referring now to FIG. 1 the gutter screen 1 presents a horizontal surface which extrudes downward into channels 2, which act to inhibit the forward flow of rainwater off a roof structure by means of their open-air areas 2*a*, having no greater than ¼ inch width of open air, which interrupt or inhibit some amount of forward water flow. The forward flow of water is further inhibited by being encouraged to flow downward into an underlying gutter due to a downward flowing water path created by the water tension that exists on the wire surfaces of 1 and 2 as they extend downward into any underlying rain gutter. This is an improvement over gutter screens presented in prior art which tend to channel water forward along their single plane or near single plane wire structures, around open air space apertures present in the same plane of the screen, and past, rather than into, a rain gutter. The side walls of channels 2 are crimped closely together contacting each other creating a honey combed wall that has demonstrated an ability to channel greater volumes of water than a solid plane or fin of the same dimensions that would extend downward. Such fins or planes have been utilized in prior art.

The downward crimped extensions 2 occurring in the horizontal plane of screen 1 also offer an improvement over prior art that employs fine screen or mesh placed over a perforated undulating or wavy support skeleton: Such prior art exhibits lateral weakness, tending to concave, and also provides fewer contact points between fine screen mesh and larger underlying support screen allowing for sagging of the supported mesh to occur. It has also been observed that sequential "waves" or undulations separated by open air space, channel a lesser volume of water downward and allow more to channel forward than does the compressed or crimped channels 2 of the present invention. Prior art that employs waves or undulations as a supporting skeleton for an overlying finer mesh, if constructed of identical material as the present invention, incurs greater cost of manufacture, as more material is required for prior art to cover the same amount of open gutter the present invention would cover.

Figure 2:
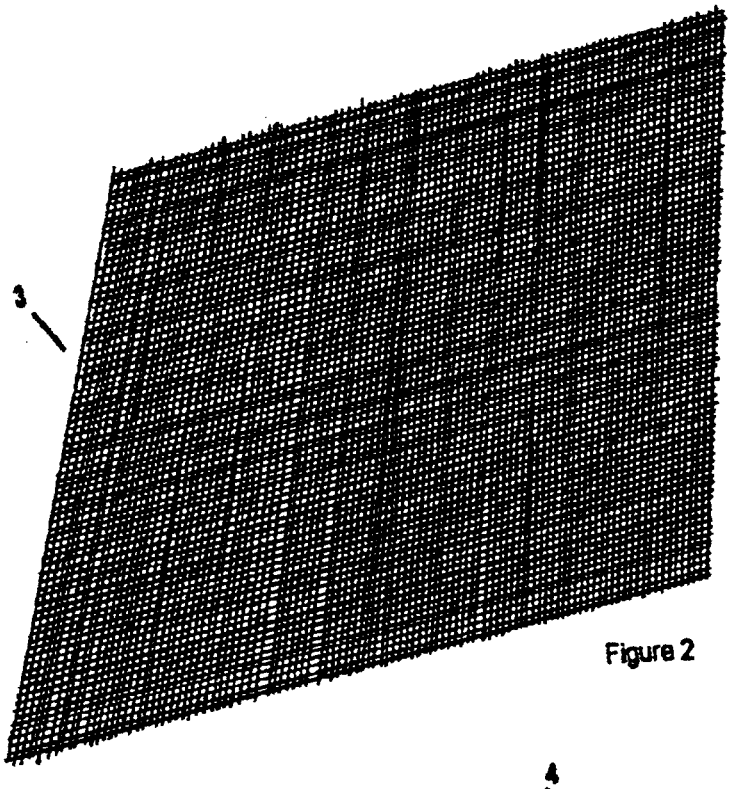
FIG. 2 is a top view of a filter membrane which is a component of the present invention.
Figure 10:
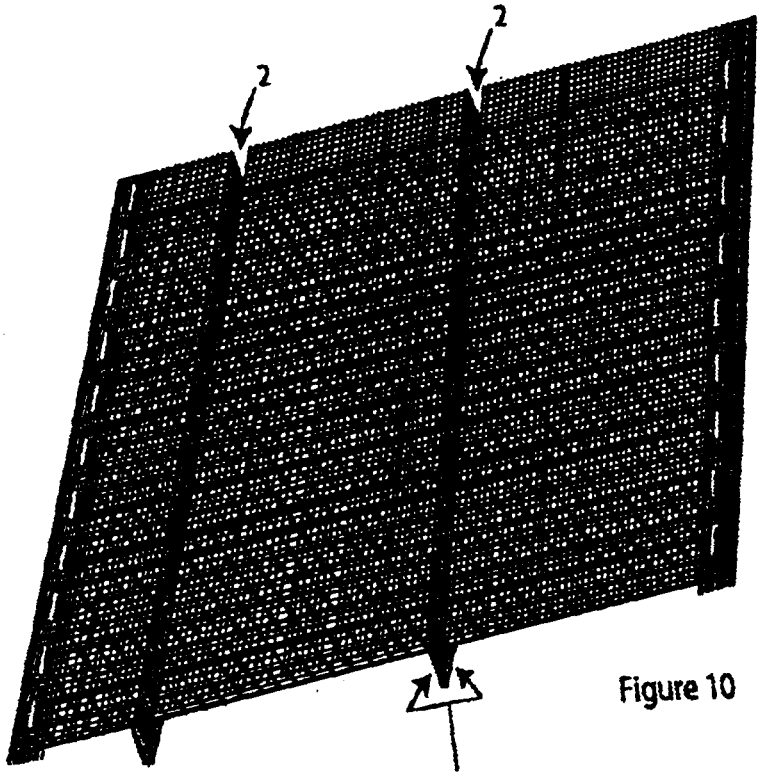
FIG. 10 is top view of components of the present invention generally shown in FIG. 4.

Referring now to FIG. 2: a filtering membrane 3 is illustrated that is comprised of warp-knit or "junctured" (threads not crossing over and under each other but, rather, passing through or adjoining each other) metal or polymer threads that form a fabric or mesh with air space between threads of approximately ≦80 microns. This particular method of fabric or mesh construction prevents the smallest of debris from "catching" and then lodging in the membrane itself as is common with filter methods, cloth, and membranes presented in prior art. Testing has shown that filtering membranes and screens so constructed, and made to contact each other in as many points as possible, as illustrated in FIG. 10, (with the points of contact being limited to no greater widths than 0.03 inches) exhibit great resistance to clogging or matting due to pollen, oil that leaches from shingles, and other pollutants that commonly coat prior art and eventually lead to the loss of water permeability and water adhesion. A particular test of the invention involved immersing the invention in 30 wt oil: within 10 seconds water permeability of the invention was regained. Prior art so tested: filters, perforated planes, fins, curved surfaces, tangled mesh, louvers, multi-channeled curved surfaces, filtering membranes over planar perforated surfaces, filtering membranes over undulating or wavy surfaces, demonstrated significant loss of water adhesion and siphoning abilities for hours and, in some instances, days.

As shown in FIG. 1 the screen 1, can have diamond shaped water receiving openings 51 having angled metal walls 52. The filtering membrane 3 can contact the top surface of the angled metal walls such that a point of contact forms angles greater than or less than 90 degrees between the bottom surface of the filtering membrane 3 and the top surface of the angled metal walls. The metal walls can be angled approximately 30–40 degrees whereby multi-angled redirection of forward water flow downward into the gutter is realized aiding siphoning and self-cleaning properties of the gutter screen. The metal walls can be angled downward and rearward from the forward longitudinal edge of the gutter screen whereby forward flow of water is further limited and redirected downward. The width of the diamond shaped water receiving openings 51 can be equal to or greater than ⅜ inch whereby water bridging paths across the water receiving openings and resulting forward flow of water is diminished.

Limiting the space between threads to approximately 80 microns, does allow sufficient water permeability, approximately 75%, to accommodate rainfall run-off if the threads are warp knit or "junctured". Tests have shown that when such cloth is tilted at angles greater than 20 degrees, forward flow of water begins and water permeability of the filtering cloth is significantly reduced. When, however, such cloth or membrane 3 is made to contact underlying planes that extend downward, additional surface tension is created at the points of contact and the siphoning ability of the filtering membrane is regained. When such downward extending planes are composed of porous sidewalls that contact each other, the siphoning ability of the filtering membrane is not only regained, but improved and water permeability (or the ability to siphon water downward through the membrane) of filtering membranes will increase and remain as high as 97% even when such membrane is tilted at angles of 50 degrees (referenced to a horizontal plane).

Figure 3:
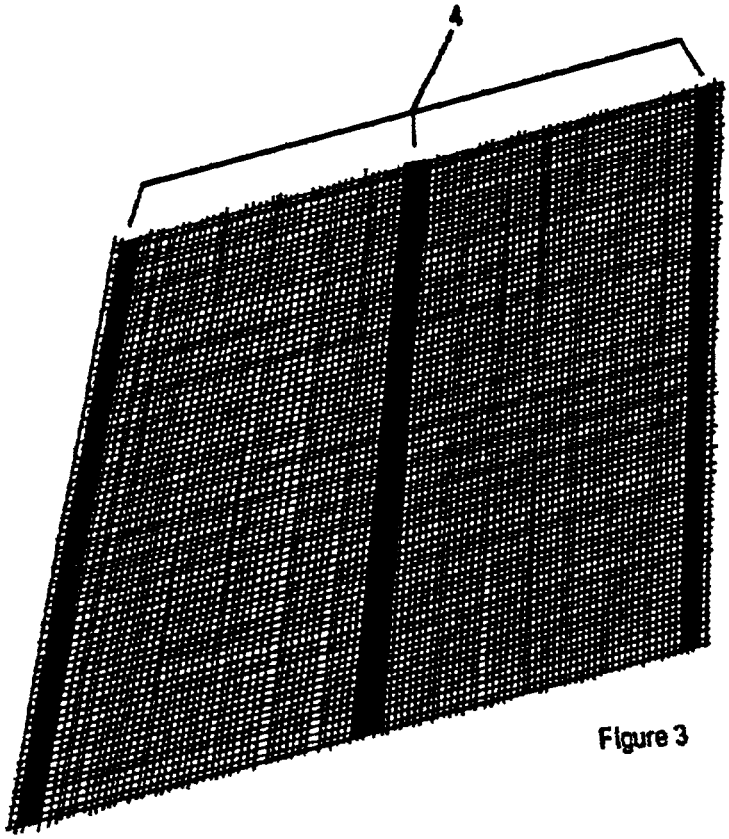
FIG. 3 is a top view of the filter membrane illustrating 3 applied adhesive strips.
Figure 4:
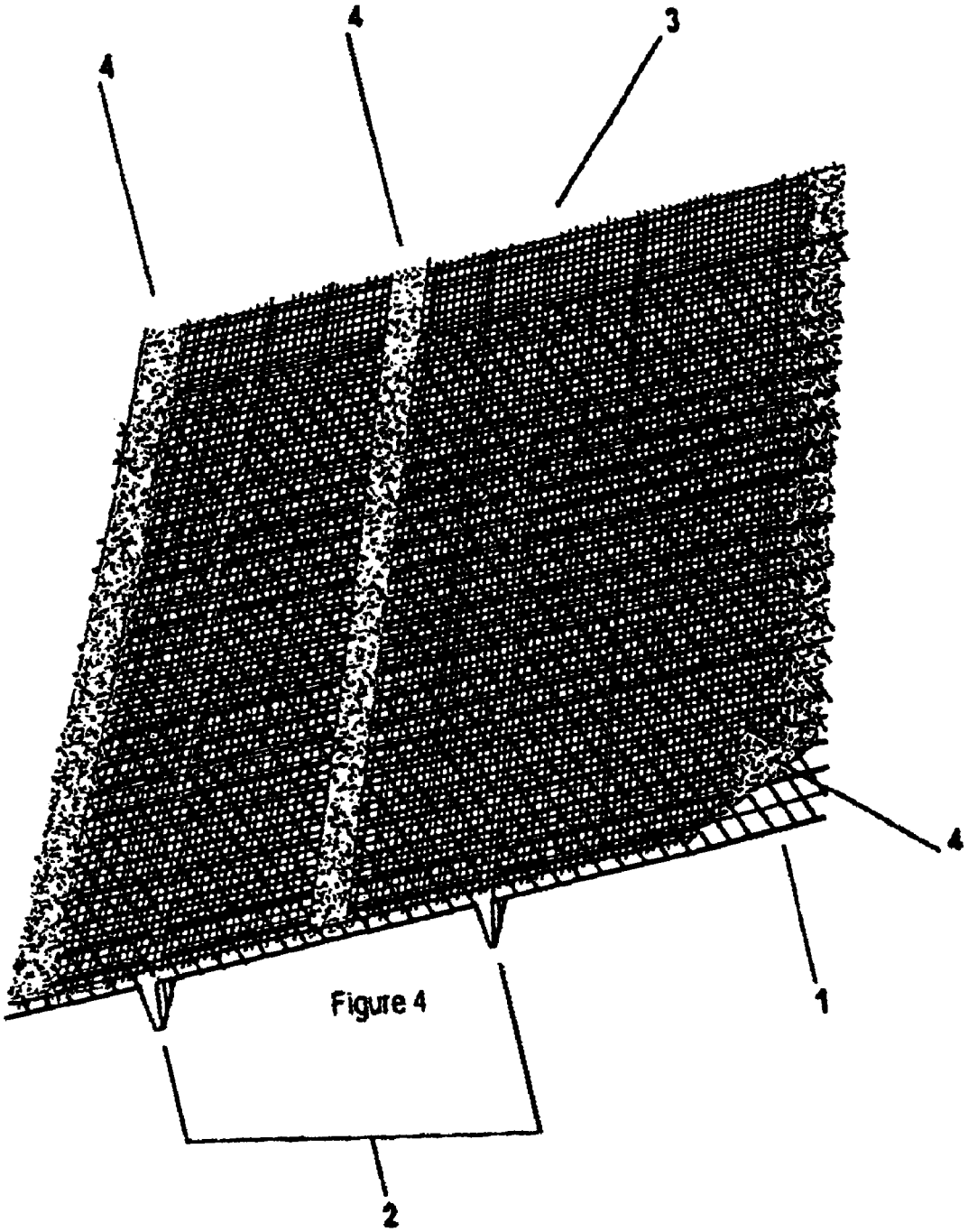
FIG. 4 is a top view illustrating the filter membrane applied and resting on an underlying support screen of expanded metal, both being components of the present invention.

Referring to FIG. 3, adhesive strips 4 are applied at each edge and at an approximate center location on the underside of filter membrane 3. This process may be accomplished at a fabric mill at the time of cloth manufacture and is one method of affixing filtering membrane 3 to underlying screen 1. Referring to FIG. 4 liquefied adhesive paths 5 are sprayed or otherwise applied to the top surface of screen 1 where they then are made to contact the underside of filter membrane 3 as an alternate method (to adhesive strips) of affixing filter membrane 3 to underling screen 1. The spraying would be accomplished at the site of the roll forming merger of membrane 3 to underlying screen 1 as is illustrated in FIG. 19: spraying head 41 spraying liquefied adhesive 5 to the top surface of screen 1

Figure 22:
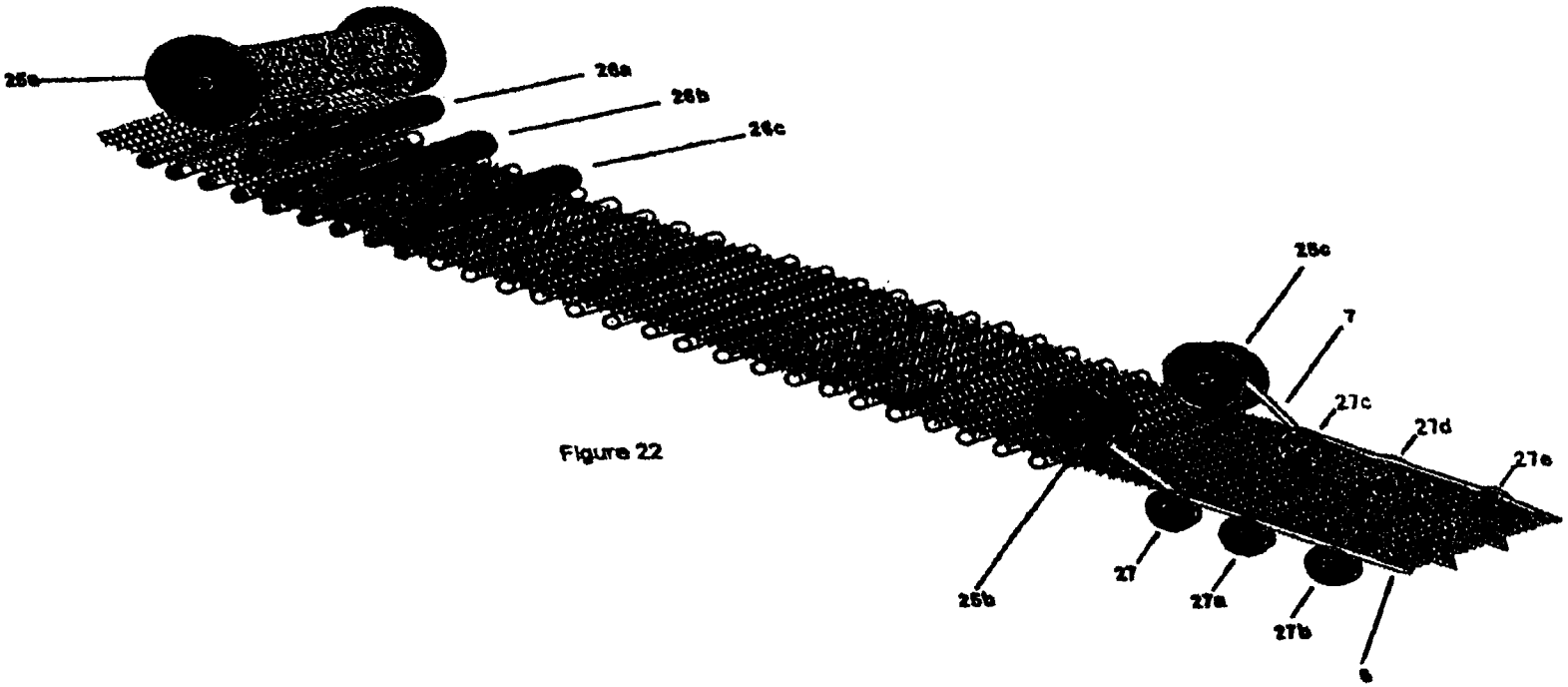
FIG. 22 is a cross sectional view of an assembling line generally shown in FIG. 20.

Referring to FIG. 22 the filter membrane 3 wound on a spool 25*a*, may be unwound and applied and pressed onto the top surface of gutter screen 1, by tensioning roller bars 26*a*, 26*b*, and 26*c* as is illustrated. The tensioning bars are intended to position the filter membrane 3 in place as the adhesive strips (or narrow paths of adhesive spray) temporarily secure the filter membrane to the gutter screen 1 allowing permanent securing sleeves 6 and 7 supplied by decoiling cylinders 25*b*, 25*c*) to be roll formed and crimped on to sides of filter screen 1 and membrane 3 by tooled dies 27, 27*a*, 27*b*, 27*c*, 27*d*, & 27*e*.

Referring to FIG. 4 it is illustrated that the adhesive strips or spray 5, which join filter membrane 3 to screen 1 are not positioned over downward extending channels 2. Doing so may create a "bridging effect" that would encourage forward water flow across the glue paths or strips rather than encourage the downward siphoning effect on water the channels 2 exhibit. The adhesive strips 4 do, however, act to impede the forward flow of water and when positioned away from channels 2: The adhesive strips or spray paths 5 indirectly allow the downward extensions 2 to more effectively siphon water downward and into the rain gutter beneath by slowing the water flow entering the downward extensions as well as slowing the lesser amounts of water that falls through the remaining non-channeled portions of screen 1.

This unique dual use of the adhesive strips or stray paths is an improvement over filtered gutter cover methods presented in prior art that tend to channel water by surface tension along single planed horizontal surfaces past the top opening of a rain gutter. This dual use of the adhesive strips or spray paths also offers an improvement over prior art that employs fine mesh over undulating or wavy support skeletons that may glue filtering mesh to the underlying skeleton along the top of undulations or waves, encouraging forward flow water paths and/or no glue paths whatsoever exist to inhibit forward water flow.

Figure 5:
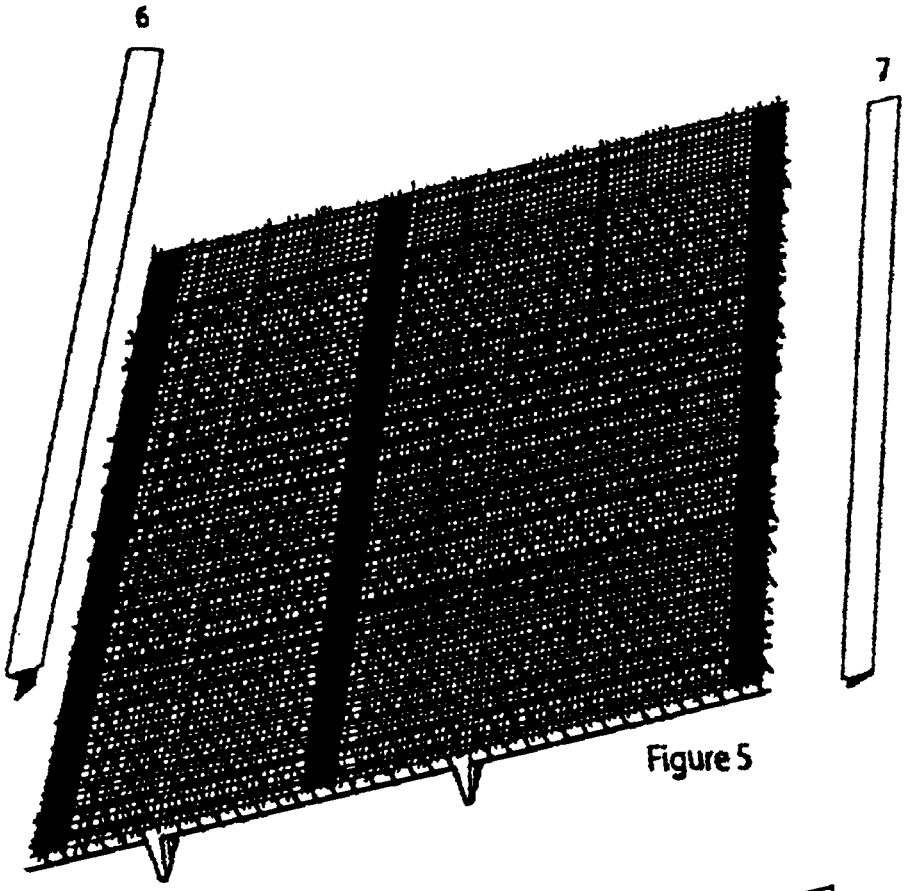
FIG. 5 is a top view of components of the present invention generally shown in FIG. 4, that introduces two fastening sleeve components of the present invention.
Figure 6:
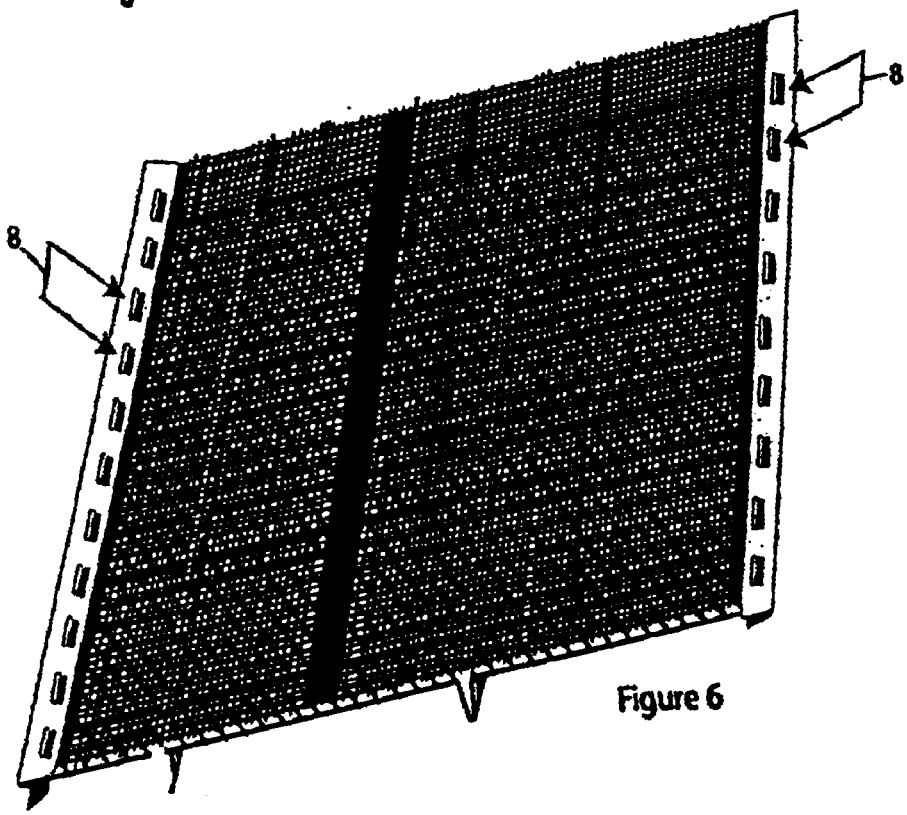
FIG. 6 is a top view of components of the present invention illustrating an alternate embodiment of securing the filter membrane and underlying screen components of the present invention.

Referring to FIG. 5, sleeve 6 is a metal or polymer "z" shaped length, approximately ½" to 1" in width, that will be crimped 8 onto the left edge of gutter screen 1 and filter membrane 3 permanently fastening them together as illustrated in FIG. 6. Sleeve 6 of FIG. 5 provides a means of fastening the left (or forward facing) edge of the invention to the top lip of a K-style rain gutter. Sleeve 7 is a metal or polymer "u" or "v" shaped length approximately ½" to 1" in width that will be crimped 8 onto the rear (or right) edge of gutter screen 1 and filter membrane 3 permanently fastening them together.

The invention offers improvement over prior art in that the junctured or warp-knit construction of both screen 1 and membrane 2, when joined and achieving as many points of contact as possible exhibits greater water permeability than has been seen in prior articles employing fine filtration membrane or cloths whose thread pattern is not so constructed: The invention also offers improvement over prior art that employs filtering screens or cloths, in different embodiments, in that the present invention exposes greater surface area, per rear to forward lateral inch, of water permeable membrane (that is able to effectively direct water flow) to oncoming rain water roof run-off by means of the present invention's downward extensions 2.

The invention, FIG. 6, additionally offers improvement over prior inventions in that it demonstrates great resistance to residual organic buildup which has been demonstrated to clog, and render ineffective, prior art over time. The combination of the particular type of a "warp-knit" or "junctured" filtration cloth or fine mesh over a screen mesh or hardware cloth with diamond shaped openings (that also employs wires junctured together on an equal plane (rather than woven up and under one another) creates a stronger downward siphoning action than is exhibited in prior art that utilizes fine or medium filter membranes or cloth fastened over underlying screens or perforated surface. The strong siphoning action, downward water channeling, and water permeability of the invention is due, in part, to the myriad of "blocks" to forward water flow presented by warp knit or "junctured" mesh or cloth: Each thread intersects or abuts another causing water flow to "brake", then climb up and over a new thread, time and time again at each thread intersection, without being able to follow a more continuous and unobstructed flow path available with other threading methods such as under and over, or knotted thread weaving, or knitting, or non-woven lofty fiber methods. Gravity is then able to exhibit more force on any water, present on the invention, than does the momentum of forward water flow.

Referring to FIG. 19, a spray jet 41 spraying a quick drying weak adhesive 5 onto the top surface of gutter screen 1 is shown as an alternative way of temporarily fastening and holding in place the filter cloth membrane 3 until sleeves 6 and 7 are crimped onto the edges of filter cloth membrane 3 and gutter screen 1 achieving a permanent fastening of the filter membrane to the gutter screen.

Figure 7:
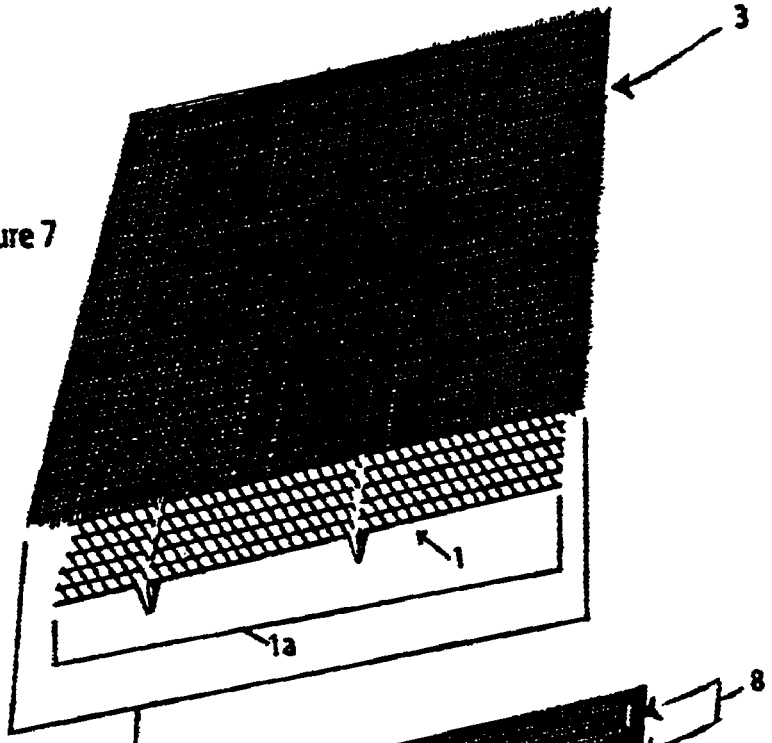
FIG. 7 is a top view of the present invention that illustrates a filter membrane of greater width than an underlying screen.
Figure 8:
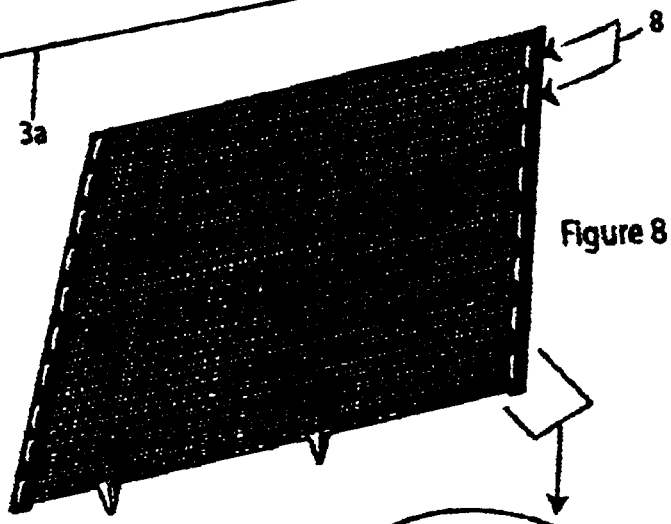
FIG. 8 is a top view of two components of the present invention merged by lapping a wider filtering membrane around lateral edges of an underlying screen and crimping both filter membrane and screen together along their respective lateral edges.

Referring to FIG. 7, there is illustrated a filter membrane 3 slit to a width wider than the underlying skeleton 1 it will attach to.

Figure 9:
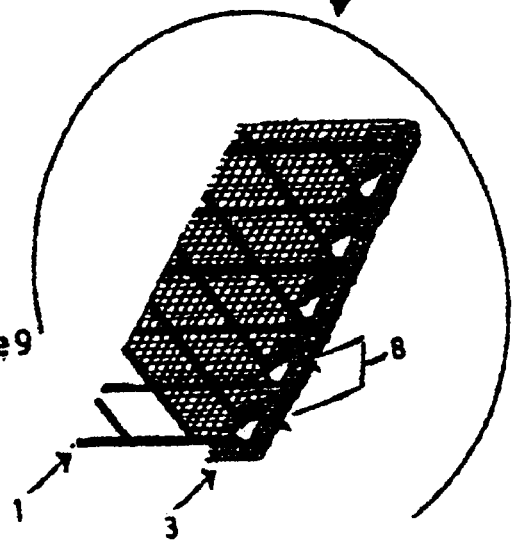
FIG. 9 is an exploded view of lateral edges of components of the present invention.
Figure 11:
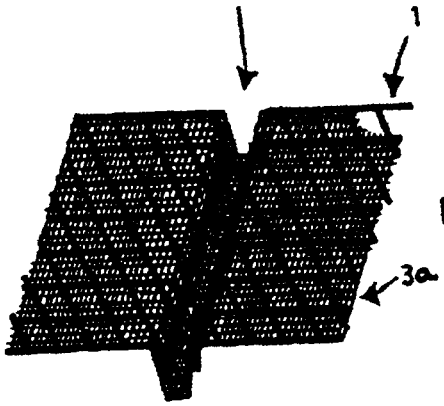
FIG. 11 is an exploded view of a water directing channel component of the present invention.
Figure 12:
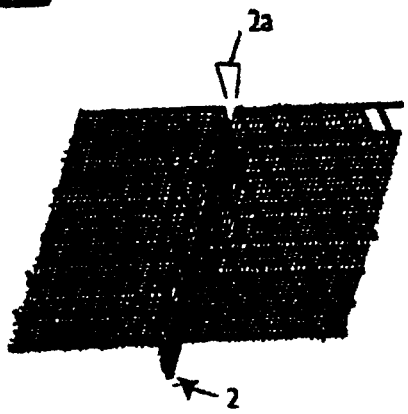
FIG. 12 is an exploded view of a water directing channel component of the present invention exhibiting walls of the channel crimped together.

Referring to FIG. 9, it is illustrated that a metal wire cloth membrane of junctured or warp-knit construction, with thread per inch counts of 100 or more, is wrapped around and under a side edge of a supporting skeleton 1. The wire cloth is then crimped 8 onto the underlying support screen. This method of securing a screening element to an underlying support structure offers an improvement over prior art in that such a securing method is easily accomplished, economical, and does not require a third additional fastening element or material Referring to FIGS. 10, 11, & 12 it is illustrated that membrane 3*a* is roll formed down into channel 2, (illustrated in the exploded view of FIG. 11). FIG. 12 illustrates that channel 2 is then crimped together so that membrane 3 and screen 1 contact each other within the well of channel 2. This embodiment of channel 2 is another, less costly, method of achieving "downward extending legs", disclosed in U.S. Pat. No. 6,598,352 Column 13 lines 40 through 47, that break the forward flow of water and redirect water away from an overlying filtering membrane and also serves to further secure membrane 3 to underlying screen 1. A downward curve of the combined screen 1 and membrane 3 is created at the top of each "leg" of channel 2 and is another, less costly, method of achieving "oval ellipses", disclosed in U.S. Pat. No. 6,598,352 Column 13 lines 47 through 51, that redirect water away from an overlying filtering membrane to underlying "downward extending legs". This embodiment of channel 2 additionally creates a honey-combed porous plane that presents a great number of downward flow paths to water which is traveling the surface of an upper plane the channels 2 are connected to.

The greater number of flow paths presented by this honey-combed embodiment of channels 2, over prior art that employs downward extending fins, or open air apertures in a singular plane, or curved surfaces, or singular filters, or filtering membranes over planar surfaces, or filtering membranes over undulating or wavy surfaces, offers improved siphoning ability and water re-direction into an underlying gutter.

Channel 2 should leave an open air space 2*a* of no greater width than ⅛ inch. FIGS. 10, 11, & 12 demonstrate the preferred securing of membrane 3*a* to underlying support skeleton 1. The roll forming of 3*a* down into channels 2 illustrates the most effective embodiment of channels 2 of the present invention: this embodiment best redirects water flow into an underlying gutter while presenting only minute areas, 2*a*, where debris may tend to gather.

Figure 13:
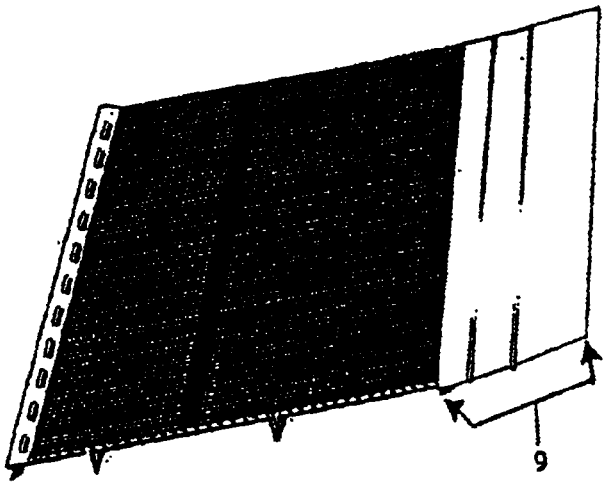
FIG. 13 is a top view of the present invention illustrating a rear attaching component.
Figure 15:
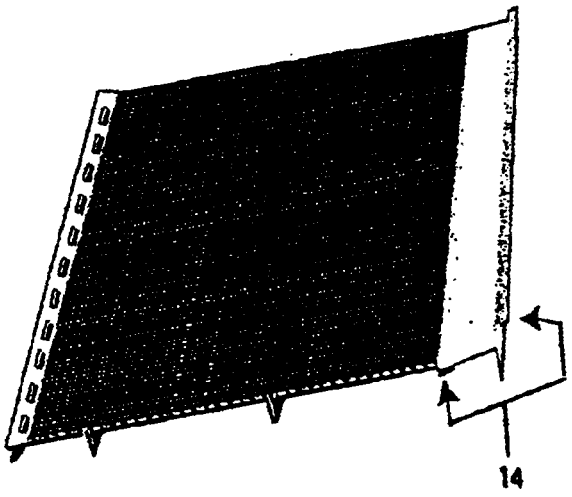
FIG. 15 is a top view of the present invention illustrating a rear attaching component unlike the rear attaching component shown in FIG. 13.
Figure 23:
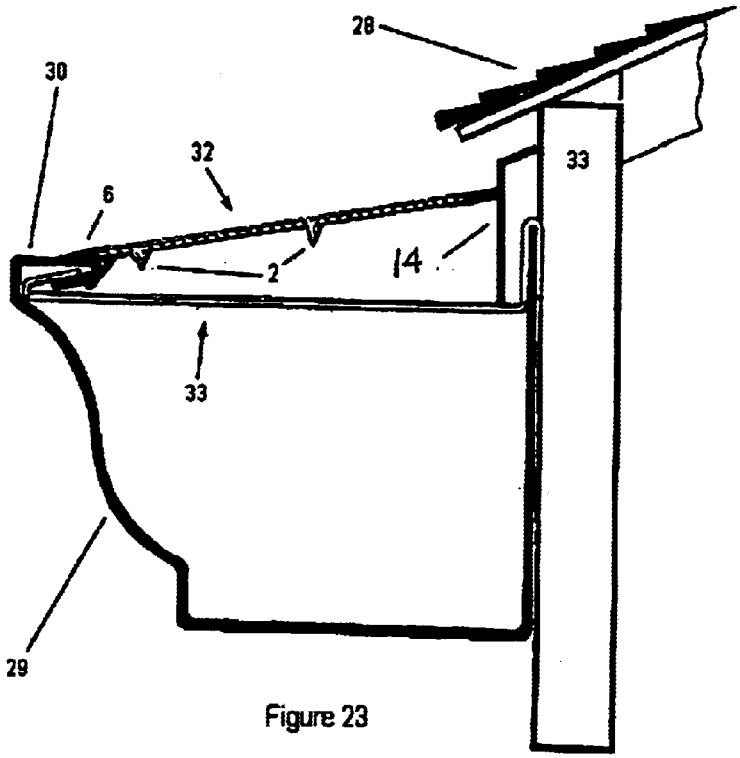
FIG. 23 is a general pictorial view, partial in cross section, illustrating a gutter cover according to the present invention and installed above a conventional gutter adjacent to a conventional building.
Figure 24:
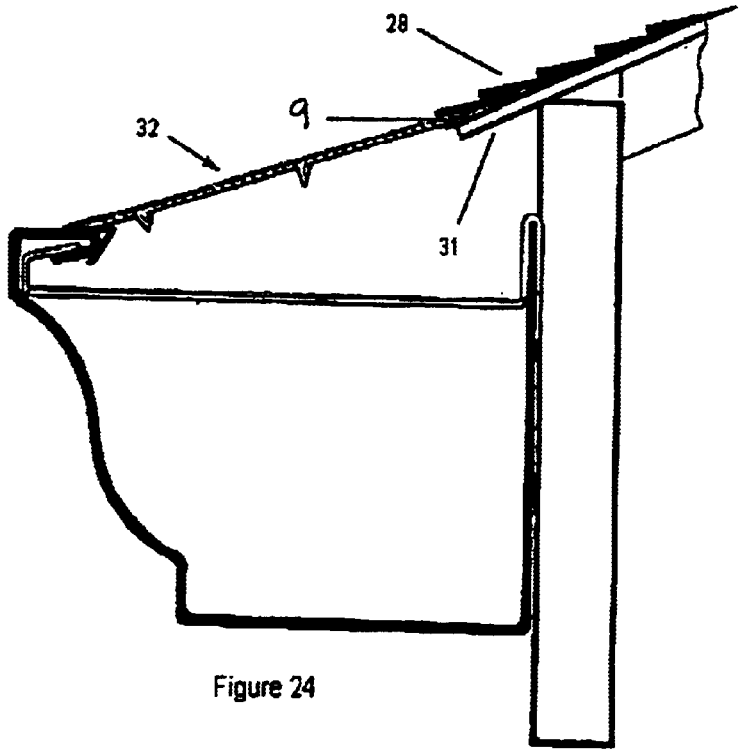
FIG. 24 is a general pictorial view of the present invention generally shown in FIG. 23, illustrating a different rear attaching member than is shown as employed by the present invention in FIG. 23.

FIG. 13 and FIG. 15 illustrate two interchangeable rear attachments: 9 and 14. The attachments have a forward securing configuration 13,15,16, and 17 that allow the attachments to interchangeably clip onto main body 1*a*. Rear attachment 9 may be utilized in instances where it may be advantageous to install the rear of the gutter cover onto, or sandwiched between, a roof membrane and underlying sub roof as is illustrated in FIG. 24. Rear attachment 14 may be utilized in instances where it is desirable to allow the gutter cover to rest wholly inside the top open end of a rain gutter and not have any part of the gutter cover extend up onto a roof as is illustrated in FIG. 23.

Figure 14:
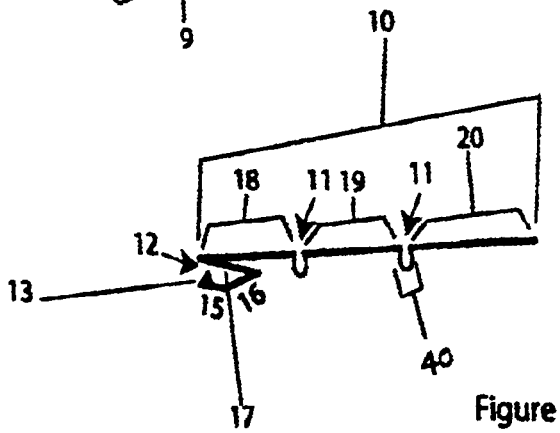
FIG. 14 is an exploded view of the rear attaching component generally shown in FIG. 13.

Referring to FIG. 14 it is illustrated that two indented channels 40 lie in plane 10 of rear channel 9. These,channels may serve to act as flex or adjusting points and to enable heating cables to be inserted into them, if desired.

Figure 16:
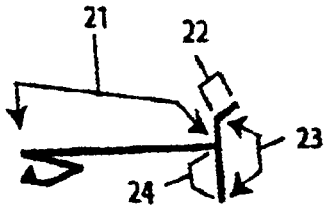
FIG. 16 is an exploded view of the rear attaching component shown in FIG. 15.

Referring to FIG. 16 an exploded view of rear attachment 14 is seen. Plane 22 of rear attachment 14 can contact a fascia board and create a rear to forward tension to secure the present invention into the,top open end of a rain gutter.

Figure 17:
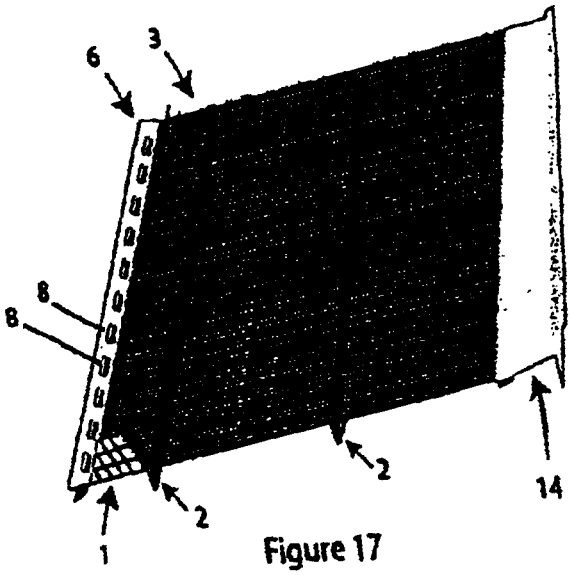
FIGS. 17 & 18 are top views of a preferred embodiment of the present invention.
Figure 18:
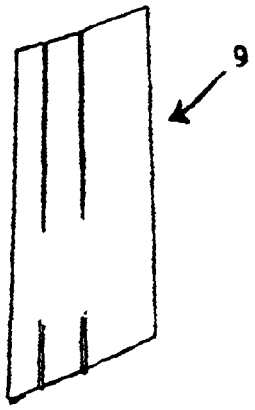
Figure 21:
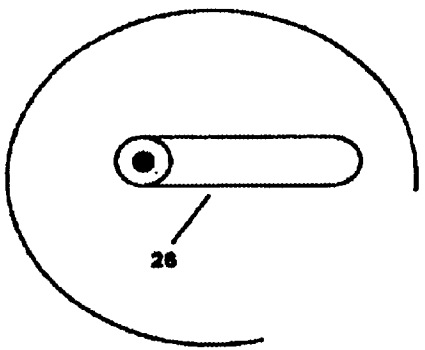
FIG. 21 is an exploded view of a tensioned roller component of the assembling line.
Figure 20:
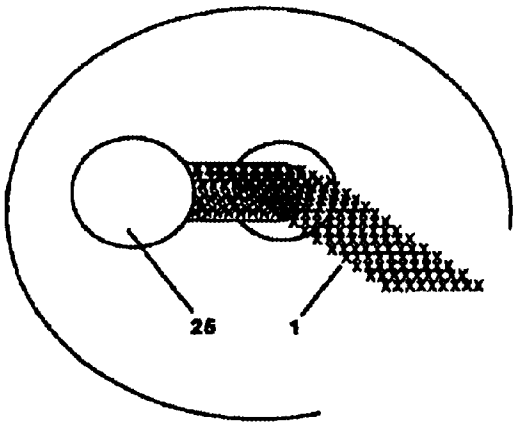
FIG. 20 is an exploded view of a roller component of the assembling line.

FIGS. 14 and 17 illustrate a preferred embodiment of the present invention: A cloth filtering membrane 3, with openings limited to no larger than 80 microns and of junctured or warp knit construction, is roll formed onto the top surface of supporting screen 1 and down into channels 2 and then roll formed around the lateral edges of support screen 1 and subsequently crimped in place near the later edges of 1 and 3, (as illustrated in FIG. 10). Channels 2 extend to lengths not less than ¾ inch and are crimped tightly together so that each side wall of the channels physically contact each other creating a micro-porous honey-combed downward extending plane. Testing has indicated that channels 2 begin to forward channel water on the underside of 1 when their length is less than ¾ inch. A z-shaped roll-formed strip 6 is then crimped onto the forward lateral edge of the present invention: 6 will act to secure membrane 3 to underlying support skeleton 1 as well as serve to secure the gutter screen (the present invention) to the forward top lip of a k-style gutter. A choice of rear attachments 14 and 9 may then act to farther secure membrane 3 to screen 1. Additionally, the attachments allow the present invention 32 to act as a rain gutter screen that may be inserted wholly into the top of a rain gutter, resting on securing spikes or gutter hangars, and held in place by rear to forward tension (when 14 is chosen as the rear attachment) as is illustrated in FIG. 23, or to serve as a gutter screen that allows for the insertion of it's rear attachment 9 beneath a roofing membrane or shingles to secure the present invention in place as is illustrated in FIG. 24.

An improvement if offered over prior art in that the interchangeability of rear attachments 9 and 14 offer a configurable gutter cover that may be adjusted for installation in a wider array of circumstances existing in the field than is offered by prior art, which are known to be limited to the single choice of either "under the shingle" installation or to "wholly inside the gutter" installation.

OPERATION

Referring to FIGS. 23 and 24, rain water will flow from a roof structure 28 onto the filtering membrane and screened plane 32 of the invention. The filtering membrane and screen combination 32 will redirect water flow downward into an underlying rain gutter. Testing has shown that 32, absent channels 2, is able to redirect approximately 50% of rainfall that contacts 32 when rainfalls of 3 to 5 inches per hour occur over roofs with 32 foot rafter spans and slopes greater than 3/12 pitch. Testing further indicates that, when plane 32 incorporates channels 2, the invention is able to redirect approximately 97% of rainfall into an underlying rain gutter (when rainfalls of 3–5 inches per hour occur over roofs with 32 foot rafter spans and slopes greater than 3/12 pitch.) Testing of the invention, in it's preferred embodiment, indicate that the invention is capable of redirecting approximately 90% of rain fall into an underlying rain gutter when rainfalls of 8–10 inches per hour occur over roofs with 32 foot rafter spans and slopes greater than 3/12 pitch. Significant water run-off or over shoot has been noted when the invention is installed on rain gutters that service roofs with pitches less than 3/12 and at "inside valleys" of hip valley roofs.

Debris, that may accompany rainfall runoff or that may, by other means, contact the invention will not lodge within or cling to plane 32. Prior art commonly allows shingle grit, oak tassels, fir needles, and other small debris to enter a rain gutter or to become within the prior art itself. Testing has indicated the present invention makes this occurrence nearly impossible. Gravity or water adhesion may temporarily cause debris to rest on top of plane 32, but it has been noted that water from roof run-off will travel beneath such debris and contact plane 32 and be directed into the underlying rain gutter 29. Debris has been noted to rest or lodge on or within prior art and cause a bridging effect which channels water past the water receiving areas of prior art and onto the ground.

It has been noted that pollen has the capacity to "cement" debris to prior art, and to the present invention. Testing has shown that pollen may coat 32 but will wash through as soon as water from roof run-off contacts it. Testing has shown this is not the case with prior art: pollen tends to remain on prior art and require physical removal for restoration of water adhesion and/or permeability.

It is illustrated in FIG. 23 that the present invention may be inserted or snapped into the top open end of a rain gutter and remain in place by a rear to forward tension existing across plane 32 that is created by attachment 14 contacting fascia board 33 and 6 contacting the top upper lip 30 of a k-style gutter. Attachment 14 rests on an underlying hangar or spike and may be notched out to fit over,them if necessary to maintain a constant level plane across sections of the invention as it is installed. Many building owners prefer that shingles or roof membranes not be lifted and disturbed due to the possible voiding of shingle warranties, and also prefer a gutter guard to install in a fashion that does not allow it to contact a building's sub roof: much prior art requires such installation.

Also, many homeowners find the appearance of a gutter guard covering the first row of shingles on their home to be unatractive. In these instances, an installer in the field may snap attachment 14 onto the rear edge of plane 32.

In some instances, a home or building owner may desire a "wholly inside the gutter" installation as is illustrated in FIG. 23, but certain sections of a rain gutter may have shingles extending down into a gutter, or straps that extend from a subroof down into the gutter or onto it's top front lip, or the gutter may have a cable or other wire directly over it and passing thought the fascia board 33 it is attached to, or a drip edge may extend down into a gutter making the installation of a "wholly inside the gutter" gutter guard difficult or impossible. In these instances, an installer may opt to snap or place attachment 9 onto the rear lateral plane of 32 and continue installation with a matched product.

The invention will be manufactured in lengths that simply butt together at installation. Either rear attachment allows for quick installation and provides a gutter guard that ensures debris as small as 80 microns, or a grain of shingle grit, will not enter a gutter, and additionally ensures the gutter guard itself will remain water permeable and effective at channeling water into a rain gutter.

I claim:

1. A gutter screen for a rain gutter having an upper opening, said gutter screen comprising:

a fine mesh screen having front and rear opposing longitudinal edges and having a top surface and a bottom surface, the fine mesh screen comprised of threads with openings between threads no greater than 80 microns, said fine mesh screen having a size and configuration to cover the opening into a rain gutter, said fine mesh screen being substantially flexible so that said fine mesh screen may be configured in roll form for the purpose of decoiling into a roll form shaping machine;

an underlying skeletal structure of expanded metal having front and rear opposing longitudinal edges with a top surface and a bottom surface, the skeletal structure having diamond shaped water receiving openings, said skeletal structure positioned below and directly connected throughout the extent of the gutter screen, said expanded metal being substantially flexible so that said expanded metal may be configured in roll form for the purpose of decoiling into a roll form shaping machine allowing for crimp attachment to and shaping with said fine mesh screen; and a forward connector portion crimped to said front longitudinal edges of said fine mesh screen and said skeletal structure of expanded metal and a rear connector portion associated with and crimped to said rear longitudinal edges of said fine mesh screen and said skeletal structure of expanded metal for installing the gutter screen to a rain gutter, wherein said fine mesh screen and said expanded metal have a plurality of downward extending channels spaced a minimum of one inch apart and parallel to said front and rear longitudinal edges of said fine mesh screen and said expanded metal.

2. A gutter screen for a rain gutter having an upper opening, said gutter screen comprising:

a fine mesh screen having front and rear opposing longitudinal edges and having a top surface and a bottom surface, the fine mesh screen comprised of threads with openings between threads no greater than 80 microns, said fine mesh screen having a size and configuration to cover the opening into a rain gutter, said fine mesh screen being substantially flexible so that said fine mesh screen may be configured in roll form for the purpose of decoiling into a roll form shaping machine;

an underlying skeletal structure of expanded metal having front and rear opposing longitudinal edges with a top surface and a bottom surface, the skeletal structure having diamond shaped water receiving openings, said skeletal structure positioned below and directly connected throughout the extent of the gutter screen, said expanded metal being substantially flexible so that said expanded metal may be configured in roll form for the purpose of decoiling into a roll form shaping machine allowing for crimp attachment to and shaping with said fine mesh screen; and a forward connector portion crimped to said front longitudinal edges of said fine mesh screen and said skeletal structure of expanded metal and a rear connector portion associated with and crimped to said rear longitudinal edges of said fine mesh screen and said skeletal structure of expanded metal for installing the gutter screen to a rain gutter, wherein said fine mesh screen and said expanded metal have a plurality of downward extending channels formed to a depth equal to or greater than ⅜ inch whereby the pull of gravity on the volume of water present on said downward extending channel is greater than water adhesion properties and forward flow velocity of roof runoff whereby the pull of gravity on said volume of water is able to break the forward flow of roof runoff and force said runoff downward into a gutter.

3. A gutter screen for a rain gutter having an upper opening, said utter screen comprising:

a fine mesh screen having front and rear opposing longitudinal edges and having a top surface and a bottom surface, the fine mesh screen comprised of threads with openings between threads no greater than 80 microns, said fine mesh screen having a size and configuration to cover the opening into a rain gutter, said fine mesh screen being substantially flexible so that said fine mesh screen may be configured in roll form for the purpose of decoiling into a roll form shaping machine;

an underlying skeletal structure of expanded metal having front and rear opposing longitudinal edges with a top surface and a bottom surface, the skeletal structure having diamond shaped water receiving openings, said skeletal structure positioned below and directly connected throughout the extent of the gutter screen, said expanded metal being substantially flexible so that said expanded metal may be configured in roll form for the purpose of decoiling into a roll form shaping machine allowing for crimp attachment to and shaping with said fine mesh screen; and a forward connector portion crimped to said front longitudinal edges of said fine mesh screen and said skeletal structure of expanded metal and a rear connector portion associated with and crimped to said rear longitudinal edges of said fine mesh screen and said skeletal structure of expanded metal for installing the gutter screen to a rain gutter, wherein said fine mesh screen and said expanded metal have a plurality of downward extending channels that are crimped so that opposing walls of said downward extending channels contact each other so that said fine mesh screen is further secured to said expanded metal.

4. A gutter screen for a rain gutter having an upper opening, said gutter screen comprising:

a fine mesh screen having front and rear opposing longitudinal edges and having a top surface and a bottom surface, the fine mesh screen comprised of threads with openings between threads no greater than 80 microns, said fine mesh screen having a size and configuration to cover the opening into a rain gutter, said fine mesh screen being substantially flexible so that said fine mesh screen may be configured in roll form for the purpose of decoiling into a roll form shaping machine;

an underlying skeletal structure of expanded metal having front and rear opposing longitudinal edges with a top surface and a bottom surface, the skeletal structure having diamond shaped water receiving openings, said skeletal structure positioned below and directly connected throughout the extent of the gutter screen, said expanded metal being substantially flexible so that said expanded metal may be configured in roll form for the purpose of decoiling into a roll form shaping machine allowing for crimp attachment to and shaping with said fine mesh screen; and a forward connector portion crimped to said front longitudinal edges of said fine mesh screen and said skeletal structure of expanded metal and a rear connector portion associated with and crimped to said rear longitudinal edges of said fine mesh screen and said skeletal structure of expanded metal for installing the gutter screen to a rain gutter, wherein said expanded metal has a plurality of downward extending channels that are crimped so that opposing walls of said downward extending channels contact each other so that a more solid downward flow path for water is created whereby forward water flow through a porous inexpensive medium is diminished.

5. A gutter screen for a rain gutter having an upper opening, said gutter screen comprising:

a fine mesh screen having front and rear opposing longitudinal edges and having a top surface and a bottom surface, the fine mesh screen comprised of threads with openings between threads no greater than 80 microns, said fine mesh screen having a size and configuration to cover the opening into a rain gutter, said fine mesh screen being substantially flexible so that said fine mesh screen may be configured in roll form for the purpose of decoiling into a roll form shaping machine;

an underlying skeletal structure of expanded metal having front and rear opposing longitudinal edges with a top surface and a bottom surface, the skeletal structure having diamond shaped water receiving openings, said skeletal structure positioned below and directly connected throughout the extent of the gutter screen, said expanded metal being substantially flexible so that said expanded metal may be configured in roll form for the purpose of decoiling into a roll form shaping machine allowing for crimp attachment to and shaping with said fine mesh screen; and a forward connector portion crimped to said front longitudinal edges of said fine mesh screen and said skeletal structure of expanded metal and a rear connector portion associated with and crimped to said rear longitudinal edges of said fine mesh screen and said skeletal structure of expanded metal for installing the gutter screen to a rain gutter, wherein the diamond shaped water receiving openings of said expanded metal have angled metal walls, said fine mesh screen contacting the top surface of said angled metal walls, such point of contact forming angles greater than or less than 90 degrees between the bottom surface of said fine mesh screen and the top surface of said angled metal walls of said expanded metal.

6. A gutter screen for a rain gutter having an upper opening, said gutter screen comprising:

a fine mesh screen having front and rear opposing longitudinal edges and having a top surface and a bottom surface, the fine mesh screen comprised of threads with openings between threads no greater than 80 microns, said fine mesh screen having a size and configuration to cover the opening into a rain gutter, said fine mesh screen being substantially flexible so that said fine mesh screen may be configured in roll form for the purpose of decoiling into a roll form shaping machine;

an underlying skeletal structure of expanded metal having front and rear opposing longitudinal edges with a top surface and a bottom surface, the skeletal structure having diamond shaped water receiving openings, said skeletal structure positioned below and directly connected throughout the extent of the gutter screen, said expanded metal being substantially flexible so that said expanded metal may be configured in roll form for the purpose of decoiling into a roll form shaping machine allowing for crimp attachment to and shaping with said fine mesh screen; and a forward connector portion crimped to said front longitudinal edges of said fine mesh screen and said skeletal structure of expanded metal and a rear connector portion associated with and crimped to said rear longitudinal edges of said fine mesh screen and said skeletal structure of expanded metal for installing the gutter screen to a rain gutter, wherein said diamond shaped water receiving openings are formed by metal walls extending downward and angled approximately 30–40 degrees whereby multi angled redirection of forward water flow downward into a gutter is realized aiding siphoning and self-cleaning properties of said gutter screen.

7. A gutter screen for a rain gutter having an upper opening, said gutter screen comprising:

a fine mesh screen having front and rear opposing longitudinal edges and having a top surface and a bottom surface, the fine mesh screen comprised of threads with openings between threads no greater than 80 microns, said fine mesh screen having a size and configuration to cover the opening into a rain gutter, said fine mesh screen being substantially flexible so that said fine mesh screen may be configured in roll form for the purpose of decoiling into a roll form shaping machine;

an underlying skeletal structure of expanded metal having front and rear opposing longitudinal edges with a top surface and a bottom surface, the skeletal structure having diamond shaped water receiving openings, said skeletal structure positioned below and directly connected throughout the extent of the gutter screen, said expanded metal being substantially flexible so that said expanded metal may be configured in roll form for the purpose of decoiling into a roll form shaping machine allowing for crimp attachment to and shaping with said fine mesh screen; and a forward connector portion crimped to said front longitudinal edges of said fine mesh screen and said skeletal structure of expanded metal and a rear connector portion associated with and crimped to said rear longitudinal edges of said fine mesh screen and said skeletal structure of expanded metal for installing the gutter screen to a rain gutter, wherein the width of said diamond openings are equal to or greater than ⅜ inch whereby water bridging paths across said water receiving opening and resulting forward flow of water is diminished.

8. A gutter screen for a rain gutter having an upper opening, said gutter screen comprising:

a fine mesh screen having front and rear opposing longitudinal edges and having a top surface and a bottom surface, the fine mesh screen comprised of threads with openings between threads no greater than 80 microns, said fine mesh screen having a size and configuration to cover the opening into a rain gutter, said fine mesh screen being substantially flexible so that said fine mesh screen may be configured in roll form for the purpose of decoiling into a roll form shaping machine;

an underlying skeletal structure of expanded metal having front and rear opposing longitudinal edges with a top surface and a bottom surface, the skeletal structure having diamond shaped water receiving openings, said skeletal structure positioned below and directly connected throughout the extent of the gutter screen, said expanded metal being substantially flexible so that said expanded metal may be configured in roll form for the purpose of decoiling into a roll form shaping machine allowing for crimp attachment to and shaping with said fine mesh screen;

a forward connector portion crimped to said front longitudinal edges of said fine mesh screen and said skeletal structure of expanded metal and a rear connector portion associated with and crimped to said rear longitudinal edges of said fine mesh screen and said skeletal structure of expanded metal for installing the gutter screen to a rain gutter, wherein said expanded metal is positioned so that angled metal walls of said diamond shaped openings are angled downward and rearward from the forward longitudinal edge of said gutter screen whereby forward flow of water is further limited and redirected downward.

* * * * *